US007377459B2

(12) United States Patent
Potts

(10) Patent No.: US 7,377,459 B2
(45) Date of Patent: May 27, 2008

(54) TOOTH CONSTRUCTION FOR A MINERAL BREAKER

(75) Inventor: Alan Potts, Somercotes (GB)

(73) Assignee: NMD Design & Consultancy Limited (GB)

( * ) Notice: Subject to any disclaimer, the term of this patent is extended or adjusted under 35 U.S.C. 154(b) by 0 days.

(21) Appl. No.: 11/431,192

(22) Filed: May 8, 2006

(65) Prior Publication Data

US 2006/0261202 A1 Nov. 23, 2006

Related U.S. Application Data

(63) Continuation of application No. PCT/GB2004/004669, filed on Nov. 5, 2004.

(30) Foreign Application Priority Data

Nov. 8, 2003 (GB) ..... 0326155.9

(51) Int. Cl.
*B02C 13/28* (2006.01)

(52) U.S. Cl. ..... 241/197; 241/294; 241/300

(58) Field of Classification Search ..... 241/189.1, 241/197, 294, 300

See application file for complete search history.

(56) References Cited

U.S. PATENT DOCUMENTS 4,162,770 A 7/1979 Lewis 4,781,331 A 11/1988 Potts

FOREIGN PATENT DOCUMENTS

| | | |
|---|---|---|
| EP | 0 167 178 | 4/1990 |
| GB | 2020572 | 11/1979 |
| GB | 2152840 | 8/1985 |
| WO | WO 98/58739 | 12/1998 |
| WO | WO 03/006165 | 1/2003 |

*Primary Examiner*—Mark Rosenbaum
(74) *Attorney, Agent, or Firm*—Thomas J. Nikolai; Nikolai & Mersereau, P.A.

(57) ABSTRACT

A tooth construction for a mineral bear, the tooth construction including a tooth shaped support body covered by a shell which defines the outer shape of the tooth construction, the shell being composed of a plurality of covers which are fixedly secured to one another and/or to the support body by welding to define a unitary tooth construction the support body having a front face and an opposed rear face and the plurality of covers including at least a front cover which is weldingly secured to and seated in face to face contact with the front face of the support body and a separate rear cover which is weldingly secured to and seated in face to face contact with the rear face of the support body.

12 Claims, 12 Drawing Sheets

TOOTH CONSTRUCTION FOR A MINERAL BREAKER

CROSS REFERENCE TO RELATED APPLICATION

This application is a continuation of prior PCT Application PCT/GB2004/004669, filed 5 Nov. 2004.

BACKGROUND OF THE INVENTION

Field of the Invention

The present invention relates in particular, but not exclusively to a tooth construction for a mineral breaker, such as disclosed in our European patent 0167178, as well as to a method of constructing a drum assembly for a mineral breaker and to a drum assembly per se.

The present invention is primarily concerned, but not exclusively, with the type of mineral breaker.

Discussion of the Prior Art

With this type of mineral breaker, mineral lumps are broken down by gripping the lumps and applying tensile forces to cause the lump to break by a snapping action.

With this type of mineral breaker, each tooth is repeatedly exposed to large breaking forces applied, on the one hand, onto the front of the tooth and then, on the other hand, onto the rear of the tooth.

In order to enable each tooth to withstand the breaking forces without snapping it is desirable to construct each tooth so as to have a core formed of a ductile metal which is covered with a tooth shell of a wear resistant material, which in itself can be relatively brittle. In order to be capable of breaking particularly hard minerals, such as for example granite, it is necessary to be able to transmit, from the drive shaft, relatively large forces. These large forces, in turn, exacerbate the securance of a tooth shell on the tooth core or horn and also require the core or horn construction to be robust enough to transmit the relatively high forces required.

According to one aspect of the present invention there is provided a tooth construction for a mineral breaker, the tooth construction including a tooth shaped support body covered by a shell which defines the outer shape of the tooth construction, the shell being composed of a plurality of covers which are fixedly secured to one another and/or to the support body by welding to define a unitary tooth construction the support body having a front face and an opposed rear face and the plurality of covers including at least a front cover weldingly secured to and seated in face to face contact with the front face of the support body and a separate rear cover weldingly secured to and seated in face to face contact with the rear face of the support body.

According to another aspect of the invention there is provided a drum construction for a mineral breaker, the drum construction including a plurality of toothed annuli mounted on a drive shaft, each annulus having a plurality of tooth constructions as defined above spaced about its circumference.

DESCRIPTION OF THE DRAWINGS

Various aspects of the present invention are hereinafter described, with reference to the accompanying drawings, in which:—

Figure 1:
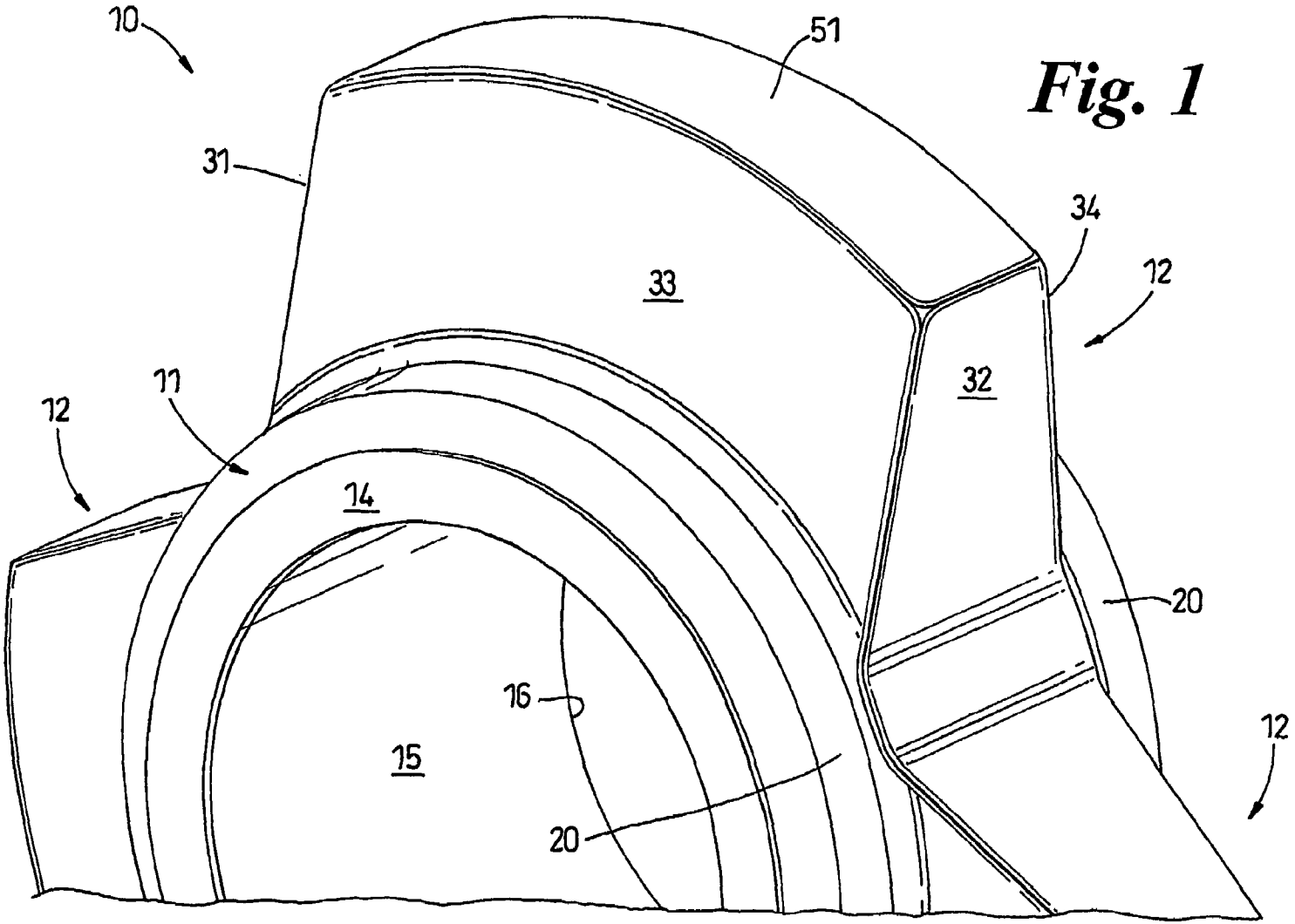
FIG. 1 is a part perspective view of a drum annulus according to an embodiment of the present invention.

Referring initially to FIG. 1, there is illustrated a drum annulus 10 having an annular boss 11 from which a plurality of tooth supports or horns 12 project radially. The annulus 10 is illustrated as having four horns 12 spaced about its circumference (one of the horns not being shown). It is envisaged that the number of horns 12 may be greater or less than four; typically the number of horns 12 would be in the range of 3 to 8.

The horns 12 have an axial extent less than the axial extent of the annular boss 11 and are centrally located relative to the axial end faces 14, 16 of the boss 11. Accordingly, on both sides of the row of horns 12 the boss 11 defines an annular shoulder 20.

The drum annulus 10 includes a through bore 15 which, in use, enables the annulus 10 to be slid onto a drive shaft. To construct a drum assembly for a mineral breaker, several drum annuli 10 are slid onto a drive shaft and each annulus 10 is fixedly secured to the shaft so as to be rotatable therewith. Preferably each annulus 10 is secured to the draft shaft by welding. This is conveniently achieved by exposing a portion of the shaft inbetween adjacent annuli and welding the annuli to the exposed portion of the shaft. Preferably the exposed portions of the shaft are defined by axially spacing opposed end faces 14, 16 of adjacent annuli and filling the resultant gap with weld.

Preferably the annulus 10 is forged in one piece from a suitable metal such that the boss 11 and horns 12 are integrally connected.

The method of construction of a breaker tooth illustrated in FIGS. 2 to 6 enable a breaker tooth of a given height to be produced. The method of construction of a breaker tooth illustrated in FIGS. 7 to 11 enable a breaker tooth of a height greater than that of the FIG. 2 to 6 embodiment to be produced whilst using the same size of drum annulus. These two methods of construction are illustrative of the principle that the same drum annulus 10 may be used to produce breaker teeth of different heights.

This is particularly advantageous since it enables the same size of drive shaft and drum annulus 10 to be used for the construction of mineral breakers having different sizes of teeth.

These two methods of construction are also illustrative of different ways of securing covers to each horn 12 to define the outer, exposed faces of breaker teeth.

The method of construction according to the embodiment of FIGS. 2 to 6 is as follows.

Figure 2:
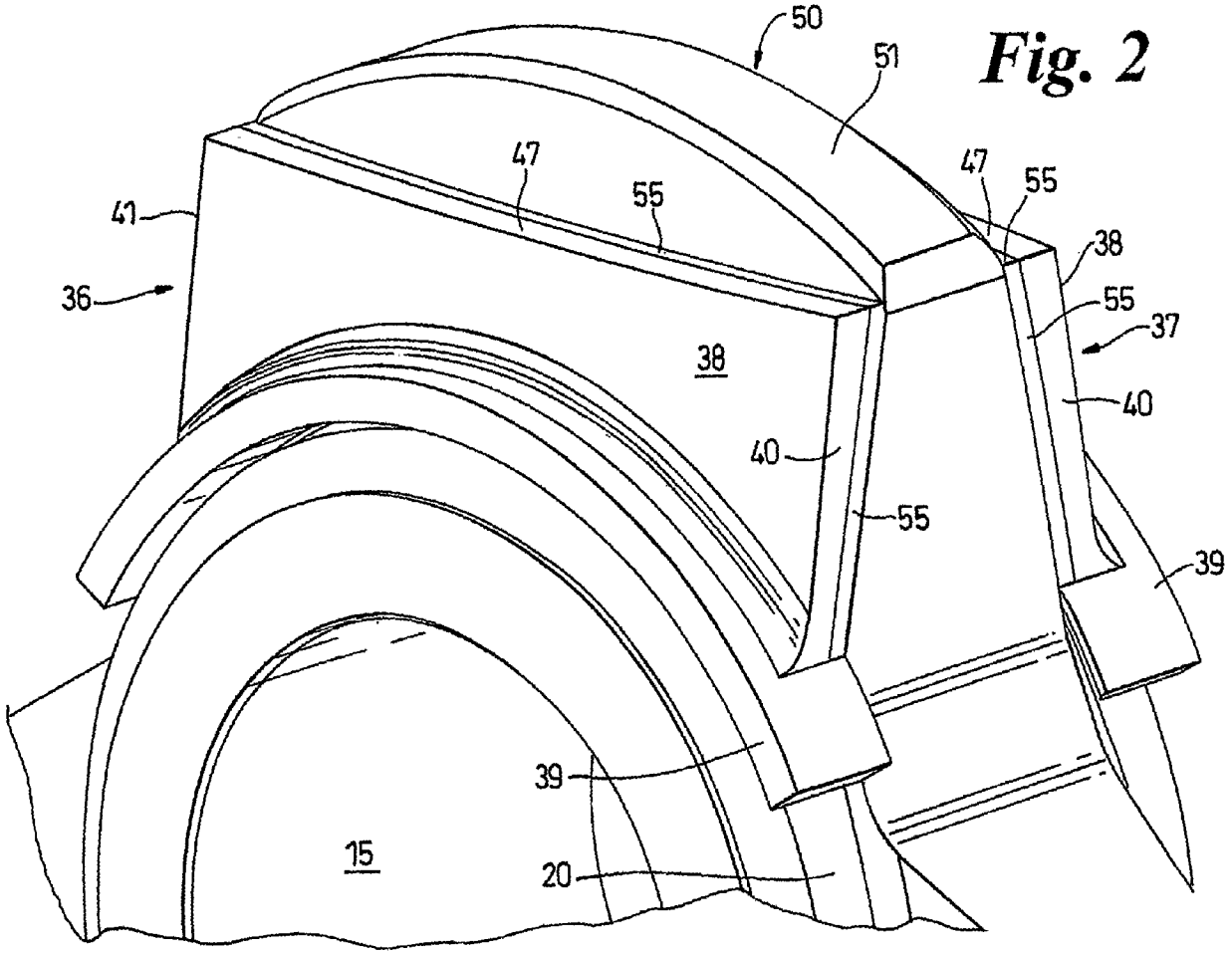
FIGS. 2 to 6 illustrate a sequence of construction steps, according to a first embodiment, for creating a toothed annulus for a mineral breaker using the drum annulus of FIG. 1.

As shown in FIG. 2, the axial side faces 33, 34 of the horn 12 are partially covered by a pair of side covers 36, 37.

Each side cover 36, 37 include a plate-like body 38 and an arcuate flange 39 located at the lower edge of body 38.

Preferably the side faces 33, 34 are planar and bodies 38 are preferably formed from a metal plate which is also planar.

The front and rear edges 40, 41 of body 38 are preferably co-planar with the front and rear faces 44, 45 respectively of the horn 12. The upper edge 47 of each body 38 is preferably rectilinear and extends from the upper part of the front face 33 to the upper part of the rear face 34 of the horn 12. Accordingly the upper portions of side faces 33, 34 are left exposed to define a crown portion 50.

The side covers 36 37 are secured to the born 12 preferably by welding. Preferably this is achieved by providing welding along the front, upper and rear edges 40, 47, 41 respectively to produce a welded seam 55. Accordingly the side covers 36, 37 are securely bonded to the horn 12.

The arcuate flange 39 is seated upon a portion of the annular shoulder 20 and serves to cover that part of the shoulder 20.

Figure 3:
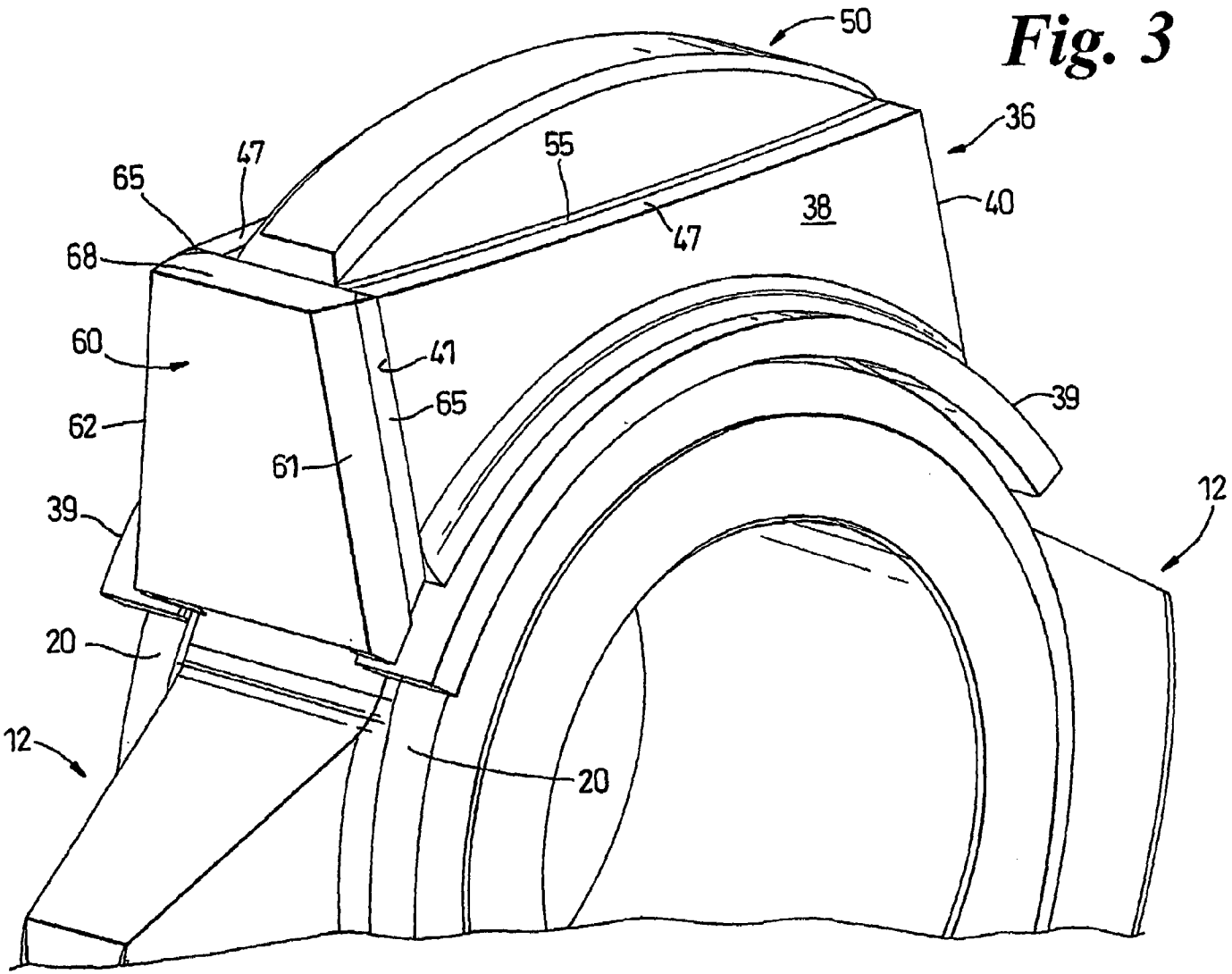

As shown in FIG. 3, a rear cover 60 is then provided which is seated in face to face contact with the rear face 31 of horn 12. The cover 60 has side edges 61, 62 which are co-planar with the outer face of bodies 38 and so covers the rear edges 41 of both side covers 36, 37. The rear cover 60 is preferably formed from a metal plate.

The rear cover 60 is secured to the horn 12 and side covers 36, 37 preferably by welding. Preferably this is achieved by welding along the side edges 61, 62 to produce welded seams 65. Whilst it is preferred that the cover 60 is directly welded to the horn 12 it is envisaged that it may be indirectly welded to the horn 12 by being welded to side covers 36, 37 only (which in turn are weldingly connected to the horn).

Figure 4:
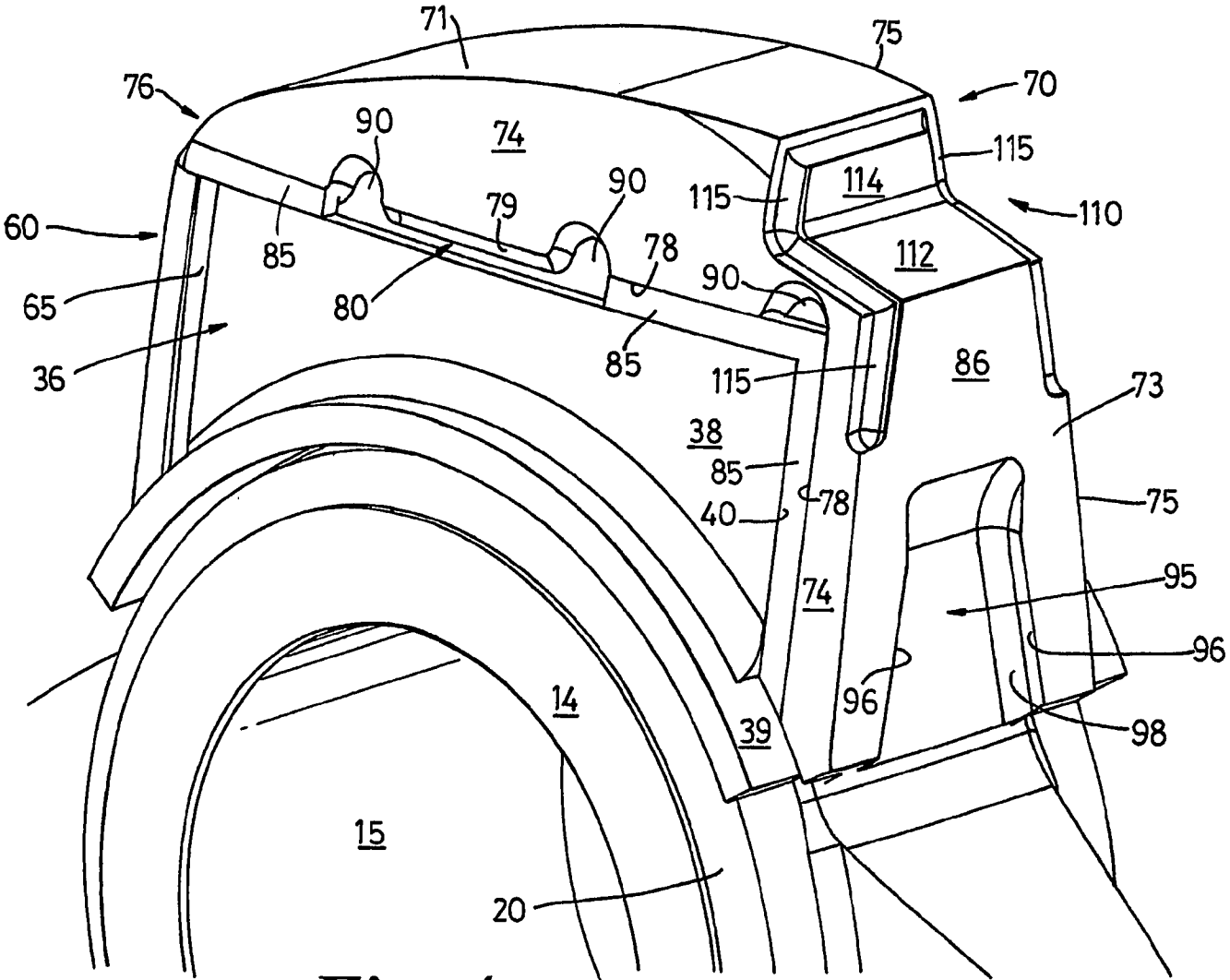
Figure 5:
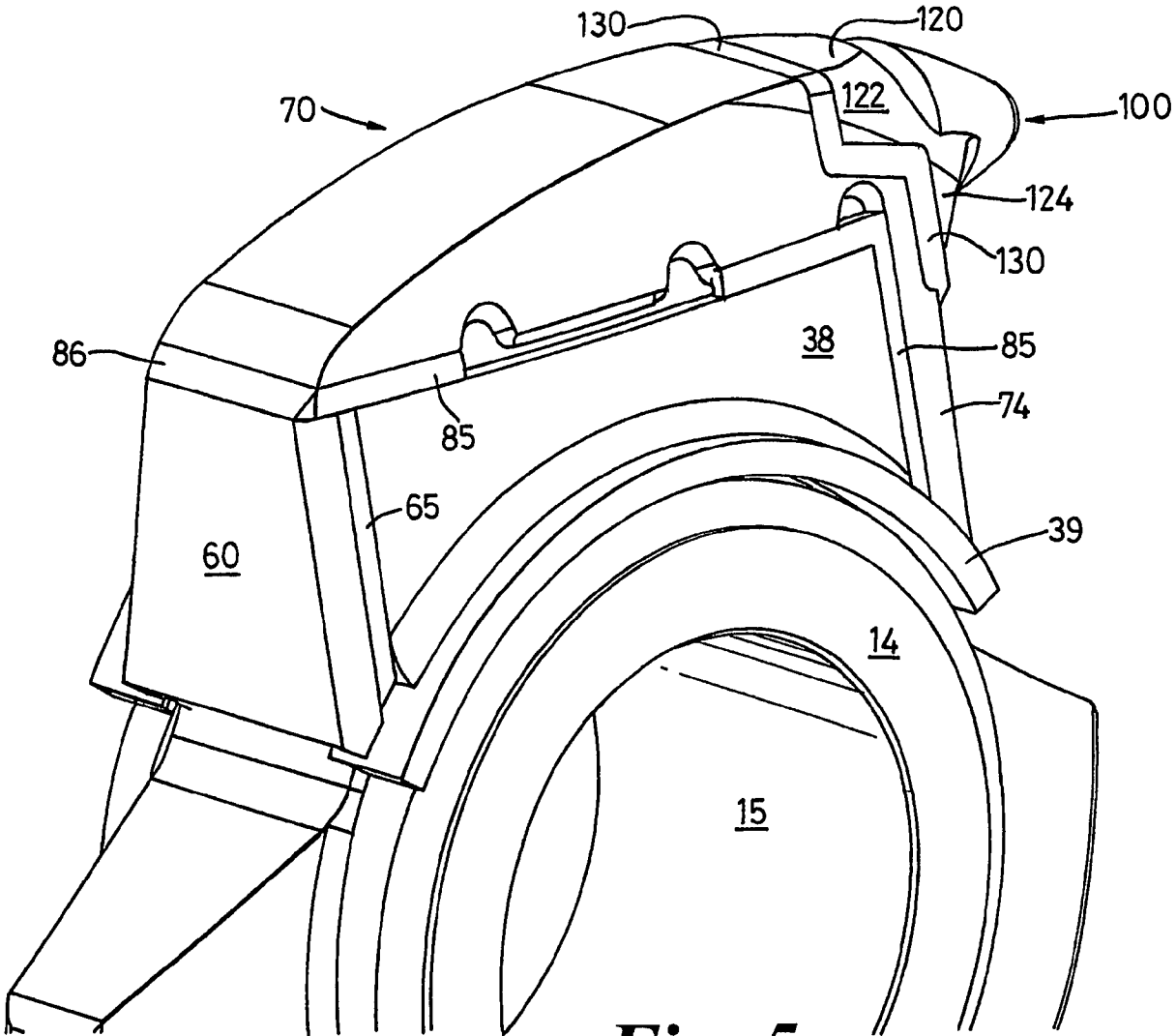

As shown in FIG. 4, the horn 12 is then provided with a front and top cover 70.

Cover 70 includes a top portion 71 which has an inner groove (not shown) of complementary shape and size to the exposed crown 50 of the horn 12 which is left exposed after securance of side covers 36, 37 and rear cover 60. Cover 70 further includes a depending front wall portion 73 which has an internal face (not shown) which is seated in face to face contact with the front face 32 of the horn 12. The front wall portion 73 has an upper front face 86 which is preferably planar. The lower portion 87 of the front wall portion 73 preferably includes a window 95. Side walls 96 of the window 95 are preferably secured to the exposed front face of the horn 12 by welded seams 98 in order to directly weldingly secure the front wall portion 73 to the horn 12.

The cover 70 has outer side faces 74, 75 which lie in the same plane as the outer face of side plates 38 and so have inner faces 78, 79 respectively which face and overlie edges 40, 47 of the side plates 38. Preferably a rear end portion 76 of the cover 70 overlies the upper edge 68 of cover 60.

Preferably the side edges of top portion 71 which define faces 78 are spaced from opposed edges 47 to form a gap 80 extending along the edge 47 (only a portion of gap 80 is shown). This enables the inner surface of the top portion 71 to seat upon the upper portion of crown 50.

The cover 70 is then secured to the horn 12 preferably by welding so as to join the opposed faces between cover 70 and plates 38 to one another via a welded seam 85.

A further welded seam 86 is preferably provided to weldingly join the upper edge 68 of cover 60 to the end portion 76.

The weld seam 85, where it extends along the upper edge 47 of each plate 38, also fills the gap 80 and so is weldingly joined to that part of the horn 12 which is exposed by gap 80. Preferably recess windows 90 are provided to enable a gouging tool to be inserted for removal of the weld seam 85 to thereby enable the cover 70 to be removed in the event of a replacement cover 70 being necessary due to wear.

To complete the tooth, a breaking tip member 100 is preferably secured to the cover 70.

Figure 6:
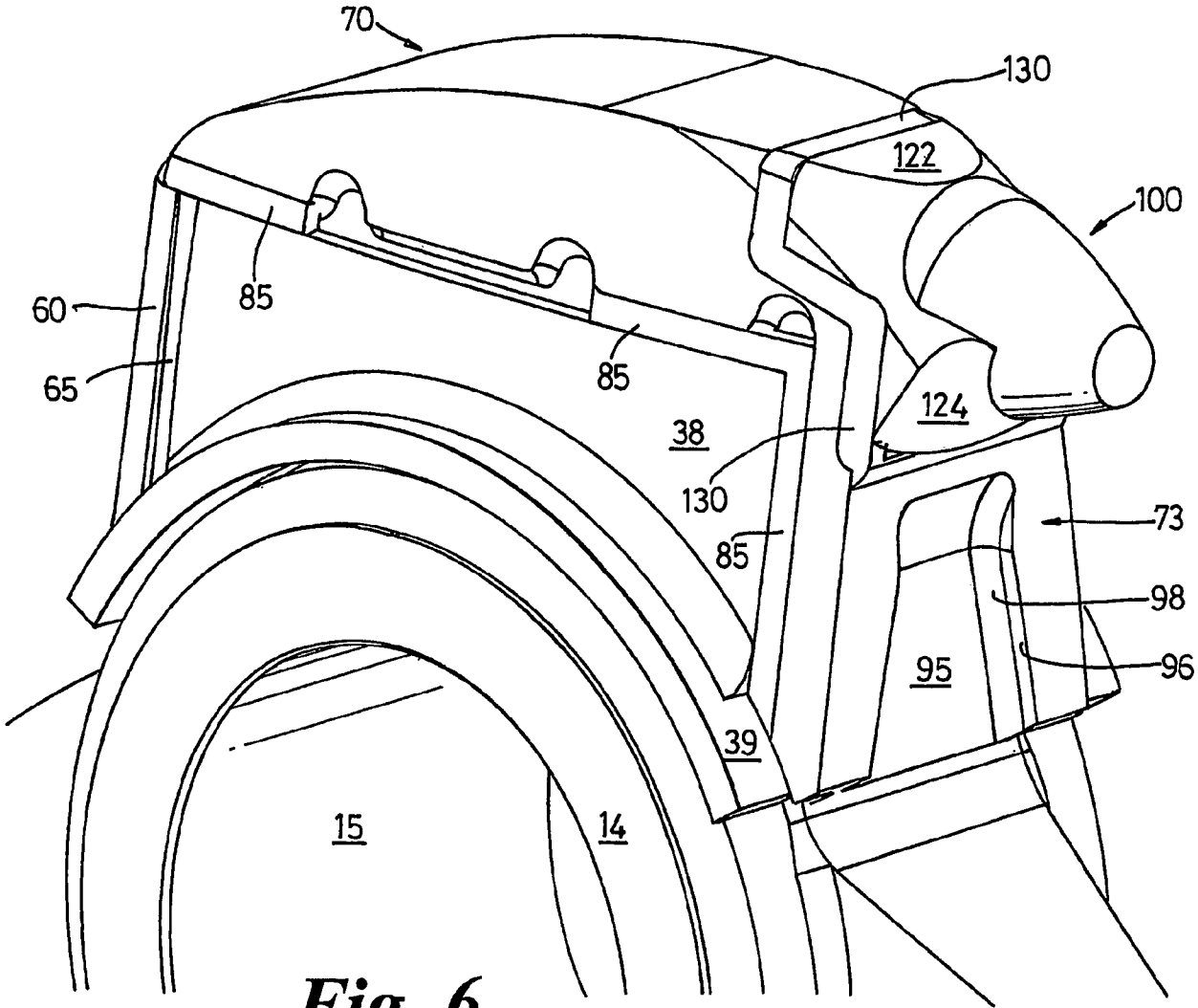
Figure 7:
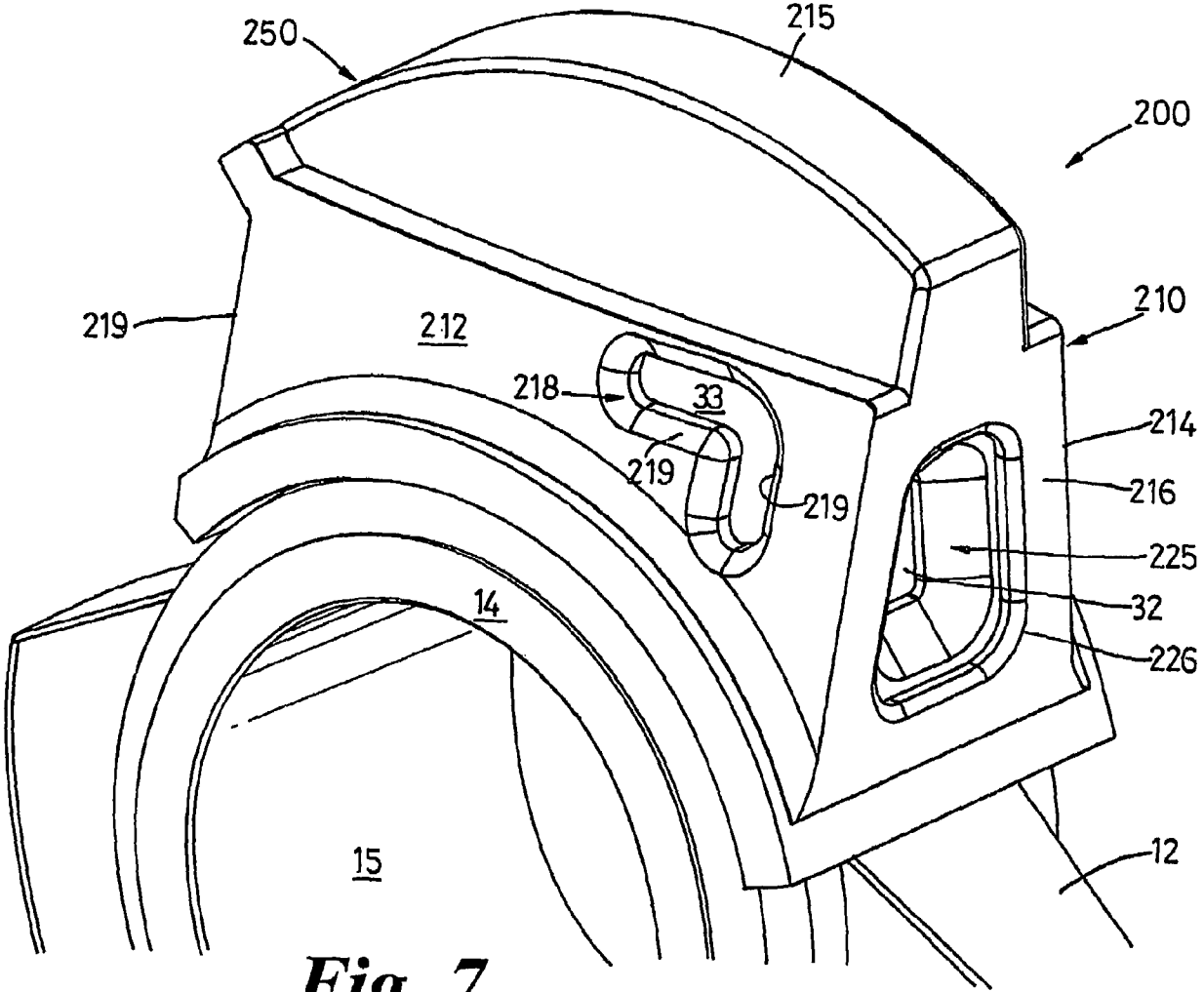
FIGS. 7 to 11 illustrate a sequence of construction steps, according to a second embodiment, for creating a tooth annulus for a mineral breaker using the drum annulus of FIG. 1.

In this respect, the cover 70 in the embodiment illustrated in FIG. 6, is provided with a recess in the form of a rebate 110 (FIG. 4) having a bottom wall 112 and an upper wall 114. A peripheral groove 115 is preferably provided which extends around the external periphery of the rebate 110 and also extends downwardly along the outer edges of the upper portion of the front portion of cover 70.

The tip member 100 preferably has a mounting body 120 (FIG. 5) in which is secured a pick-like tip 121. The mounting body 120 has an upper part 122 which seats in rebate 110 and a lower depending part 124 which has an inner face which lies in face to face contact with the upper front face 86 of wall portion 73. The body 120 has outer edges which overlie the peripheral groove 115 and is preferably secured to the cover 70 by a welded seam 130 extending along groove 115.

The above arrangement produces a breaker tooth in which a horn 12 is provided which is completely enclosed by a fabricated shell-like tooth cap defined by covers 36, 37, 60 and 70. The tooth cap is fabricated in-situ on the horn 12, preferably by welding covers 36, 37, 60, 70 to one another and/or the horn 12. This provides a very strong tooth construction having a shell-like construction which is securely fixed to the horn 12.

In this construction, the front of the tooth is fully seated on the horn front face 32 at the time of assembly and so is highly resistant to loosening during operation by being exposed to impacts on the front of the tooth. Similarly, the rear of the tooth shell (as defined by plate 60) is fully seated on the rear face 31 of the horn during assembly and is fixed in position independently of the front of the tooth. This means that the rear plate 60 of the shell is highly resistant to loosening by impacts on the rear of the tooth. It follows therefore that the fabricated shell is highly resistant to loosening by repeated alternate impacts to the front and rear of the tooth.

As wear takes place, in use, replacement covers can be simply installed by removal of the worn cover and insertion of a new one. Removal is easily achieved by first removing the relevant welded seam.

In particular, the part most likely to require replacement due to wear, viz. the breaking tip member 100, is easily replaced by removal of seam 130.

The embodiment 200 illustrated in FIGS. 7 to 11 is an example of a tooth construction which uses the same sized tooth horn 12 as the embodiment of FIGS. 1 to 6 but has a tooth height which is greater than that of the tooth in FIG. 6.

In FIGS. 7 to 11, parts similar to those in FIGS. 1 to 6 are designated by the same reference numerals.

In embodiment 200, the horn 12 is first covered with a cover 210 which is preferably cast from a suitable metal. The cover 210 has a pair of opposed sides 212, 214, a front wall 216 and a top 215. The cover 210 has an open back (not shown).

The cover 210 defines an internal pocket which has faces which seat in face to face contact with faces 32, 33, 34 and 50 of the horn 12.

The side walls 212, 214 include at least one window or aperture 218 which exposes a portion of the underlying face 33 or 34 of the horn 12. The aperture 218 has side walls 219 which are secured to the exposed face 33 or 34 of the horn 12 by welding. Preferably the entire aperture 218 is filled with weld.

Similarly, the front wall 216 is provided with at least one window or aperture 225 which exposes a portion of face 32.

The aperture 225 has side walls 226 which are secured to the exposed portion of face 32 by welding.

The rear end faces 219 of the cover 210 are preferably co-planar with the rear face 31 of horn 12 and are secured to the horn 12 by a welded seam extending between the internal edges of faces 219 and the horn 12.

Accordingly the cover 210 is securely fixed to the horn 12 by welding located at the front, both sides and rear of the cover 210.

The top 215 of cover 210 defines an upper crown 250 of similar shape to crown 50.

Figure 8:
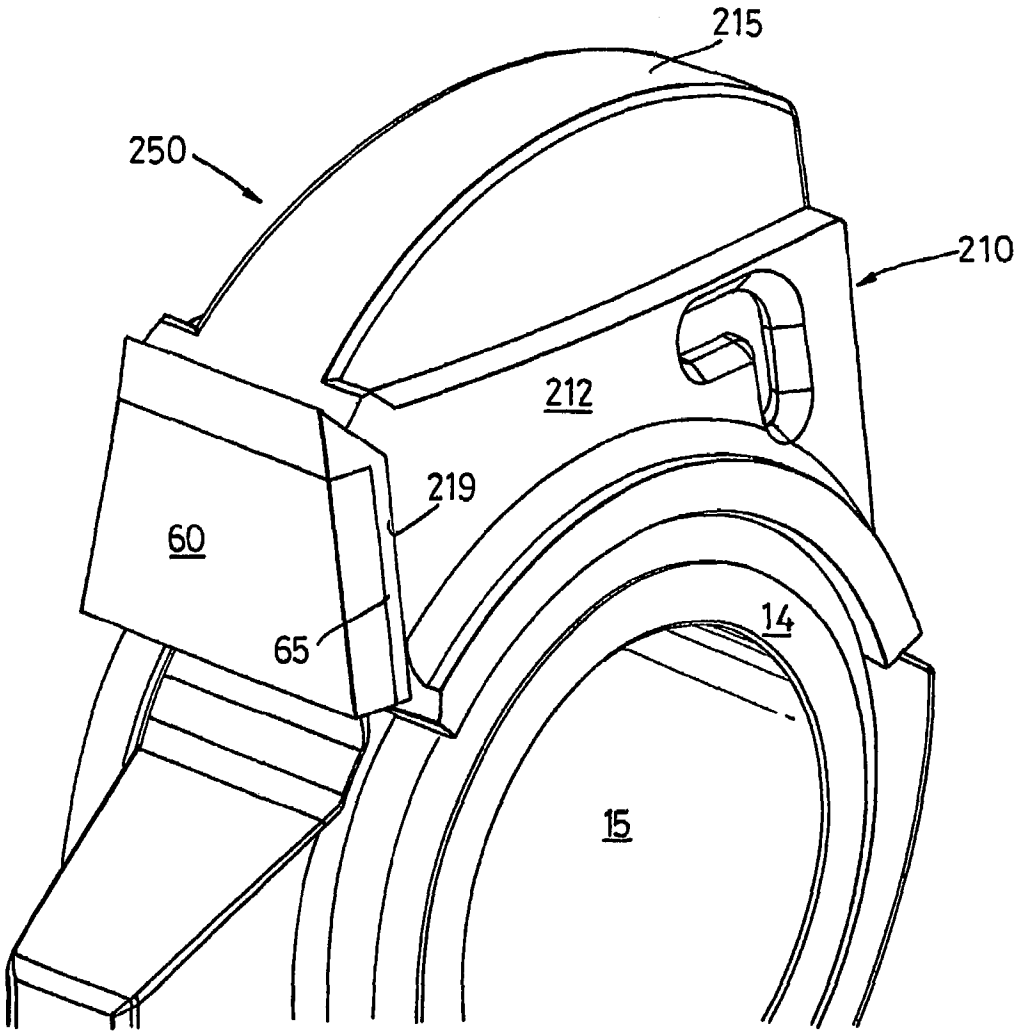

As shown in FIG. 8, a rear cover 60 is provided which overlies the rear face 31 and end faces 219 of the cover 210. The cover 60 is formed of a metal plate and is located in face to face contact with rear face 31. It is secured to the cover 210 and horn by a seam of weld 65 which extends along both sides of plate 60.

Figure 9:
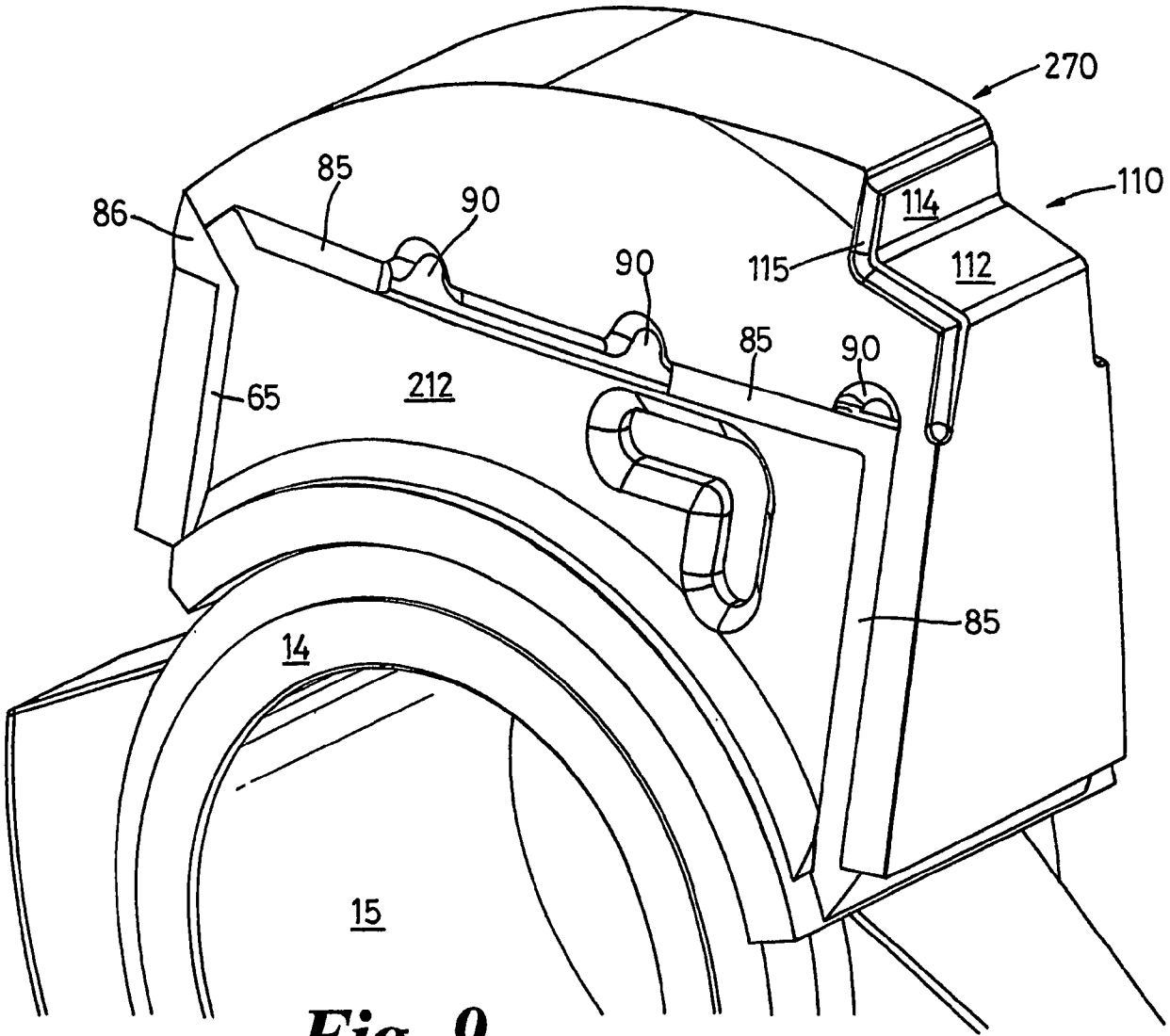
Figure 10:
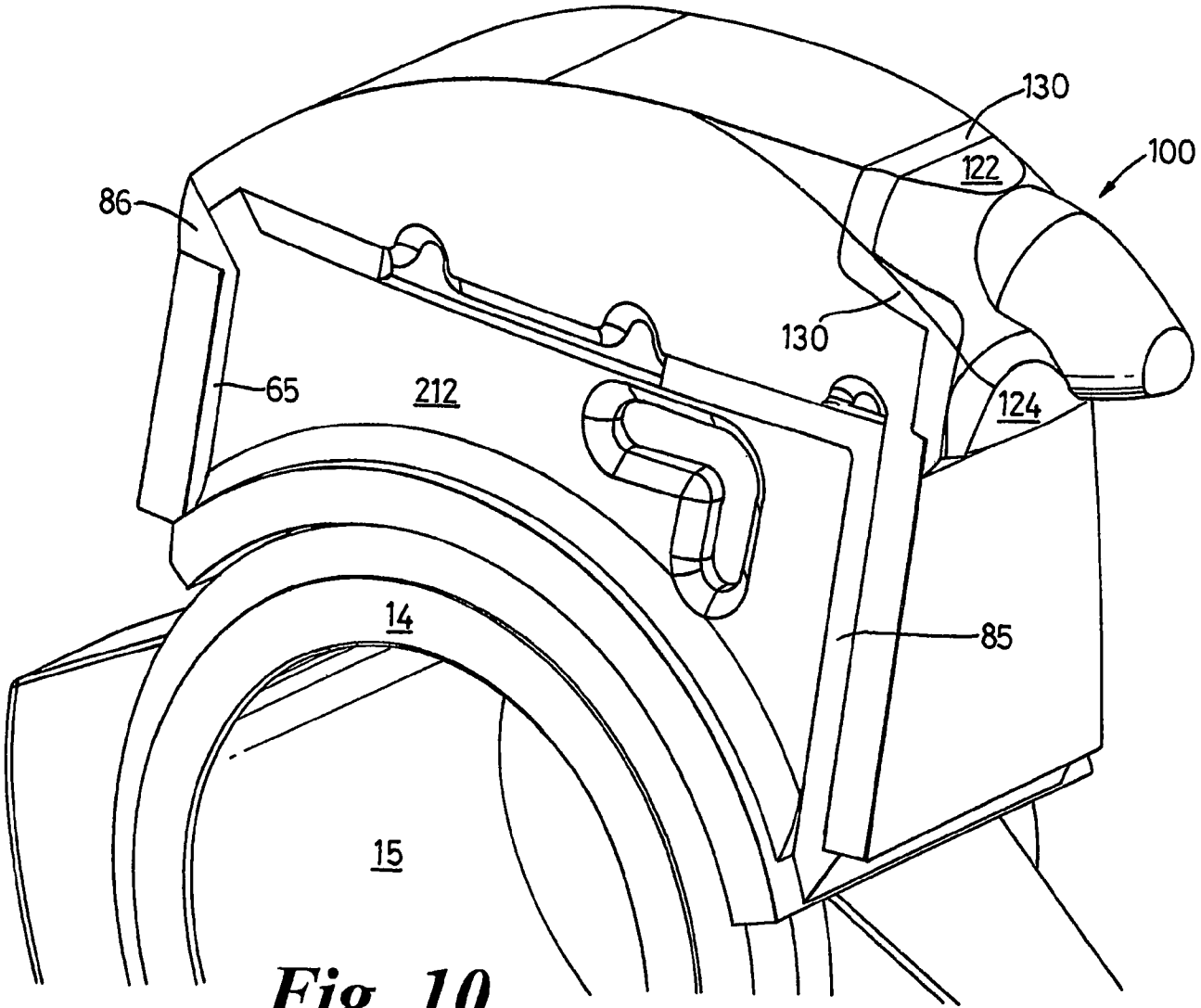
Figure 11:
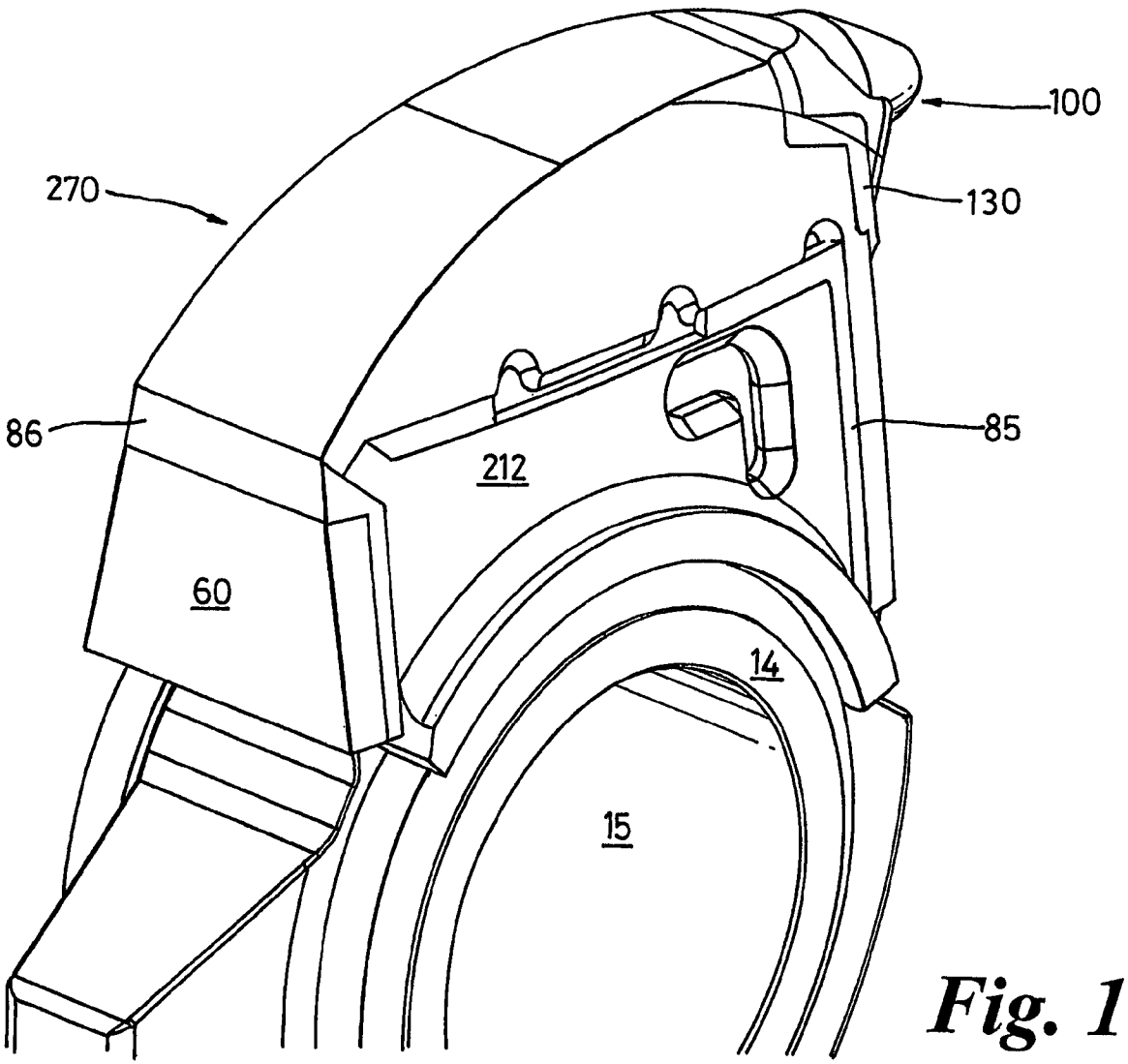

As shown in FIG. 9, a cover 270 similar to cover 70 is located on the crown 250 and is secured in place by welded seams 85.

The cover 270 is provided with a tip member 100 which is secured in position by welded seam 130.

It will be appreciated, therefore, that the tooth provided by the construction according to FIGS. 7 to 11 has a greater radial height than the tooth of FIGS. 1 to 6 primarily because of the provision of an intermediate cover 210 having a crown 250 which is located between crown 50 of the horn and the outer cover 270.

The above construction of breaker tooth, as exemplified in FIGS. 1 to 6 and 7 to 11, provide a very strong breaker tooth since welding of the covers to the horn in effect adds strength to the horn.

This means that the tooth construction of the present invention can transmit relative high forces for breakage of very hard minerals with a reduced risk of snapping and in addition without a risk of the tooth shell or cover working loose.

The strength of the tooth construction according to the invention is also enhanced by the fact that the horn is solid, i.e. does not contain through bores as is commonly required with prior art constructions.

Figure 12:
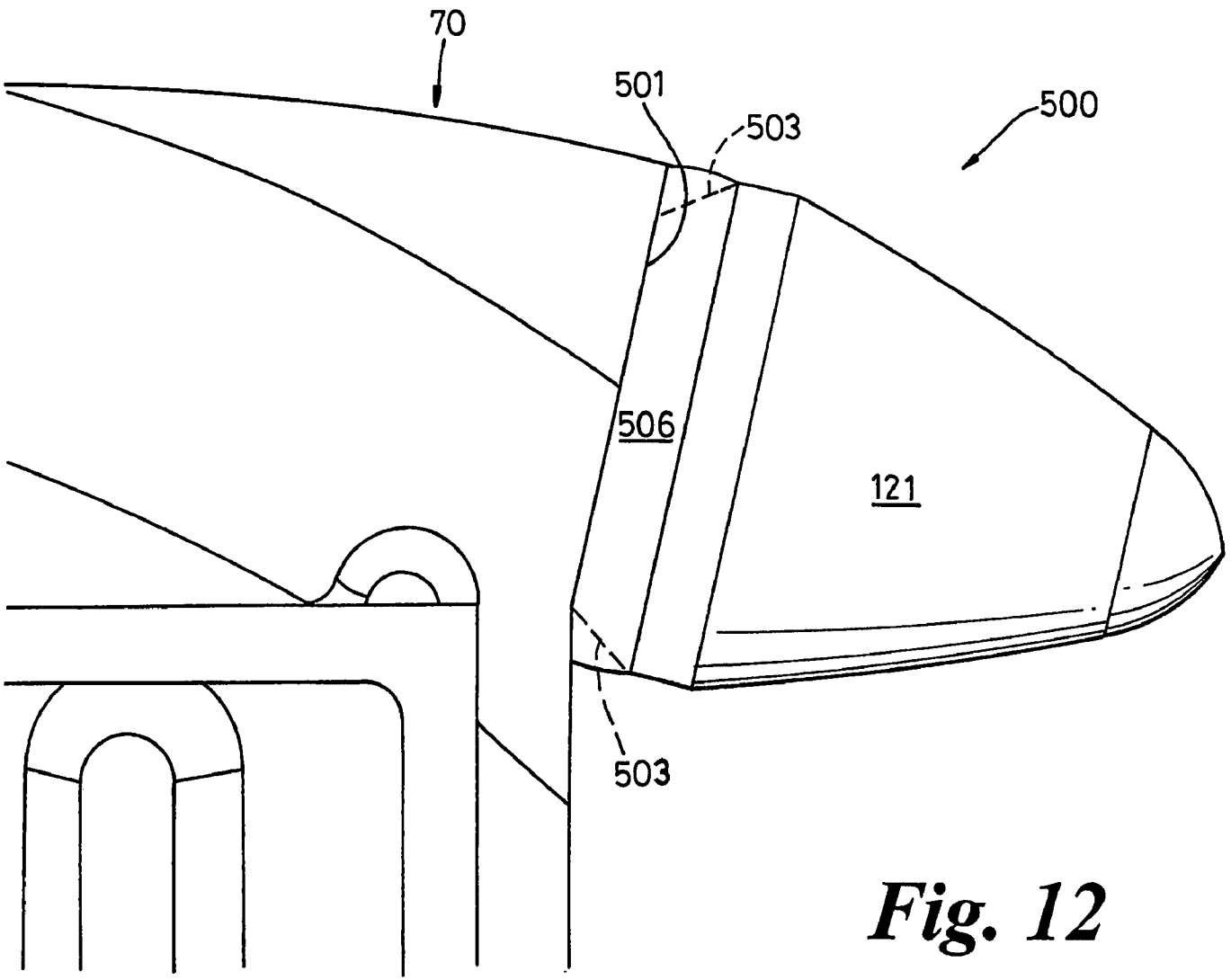
FIG. 12 is a part side view of a tooth construction according to a further embodiment of the invention.

An alternative embodiment 500 is illustrated in FIG. 12 which is a modification to the embodiments described above. In FIG. 12, parts similar to those in FIGS. 2 to 11 have been designated by the same reference numerals.

In embodiment 500, the rebate 110 in cover 70 is dispensed with and replaced by a planar inclined wall portion 501. In embodiment 500, the tip member 100 is defined by pick-like tip 121 only. Tip 121 is provided preferably with a chamfered bottom edge 503 to enable it to be welded directly to inclined wall portion 501 via a recessed welded seam 506.

Since the tip 121 is welded directly to wall portion 501, it may be formed as a regular cone and as such be made of any suitable metal by any suitable technique, e.g. it can be a machined block of metal, it can be formed from rolled metal, etc. It follows therefore that the tip 121 may be easily shaped and heat treated prior to mounting on the wall portion 501 and so enables the tip 121 to be tailored to cope with the mineral to be broken. Replacement of the tip 121 is particularly easy as it simply involves removal of the welded seam 506 (which in itself is straightforward as the seam 506 is located in a plane), cleaning up of wall portion 501 (which may simply be done with a disc grinder) and then mounting and welding into place a new tip 121.

In order to assemble a drum construction for a mineral breaker, it is preferably envisaged that a plurality of tooth annuli 10 are slid onto a drive shaft and are spaced axially apart along the shaft and at desired rotary positions relative to one another. Spacing adjacent annuli 10 apart defines an annular channel extending circumferentially about the shaft wherein the bottom of the channel is defined by an exposed circumferential portion of the shaft and opposed sides of the channel are defined by opposed axial end faces 14, 16 of adjacent annuli bosses 11. The adjacent annuli 10 are then secured in position by welding the end faces 14, 16 to the exposed circumferential portion of the drive shaft, preferably by filling the defined channel with weld.

Once the annuli 10 have been secured to the drive shaft, the breaker teeth are then constructed in situ.

An advantage of securing the annuli to the drive shaft by welding is that the diametric size of the annular boss 11 can be reduced due to the absence of keyways and so enables a drive shaft of a relatively greater diameter to be utilised in the same size of toothed annulus. A relatively larger diameter shaft is advantageous as it enables a greater power or force to be delivered to the breaker teeth.

The invention claimed is:

1. A tooth construction for a mineral breaker, the tooth construction including a tooth shaped support body covered by a shell which defines the outer shape of the tooth construction, the shell being composed of a plurality of covers which are fixedly secured to one another and/or to the support body by welding to define a unitary tooth construction the support body having a front face and an opposed rear face and the plurality of covers including at least a front cover which is weldingly secured to and fully seated in face to face contact with the front face of the support body and a separate rear cover which is weldingly secured to and fully seated in face to face contact with the rear face of the support body.

2. A tooth construction according to claim 1 wherein the support body has a pair of side faces and a top face.

3. A tooth construction according to claim 2 including first and second side covers overlying respective side faces of the support body, the side covers being in face to face contact with respective side faces of the support body and being secured thereto by welding.

4. A tooth construction according to claim 3 including a top cover having a top wall and a depending front wall, the front wall defining said front cover, the top wall and front wall overlying respective top and front faces of the support body, the top cover being weldingly connected to opposed side edges of the side covers.

5. A tooth construction according to claim 4 wherein a gap is provided between the top cover and at least some of the opposed edges of the side covers to thereby expose a portion of the underlying faces of the support body, said gap being filled with weld to weldingly connect the top cover, the side covers and support body to one another.

6. A tooth construction according to claim 5 wherein the rear cover is secured to opposed edges of the side covers and top cover by welding.

7. A tooth construction according to claim 4 wherein the rear cover is secured to opposed edges of the side covers and top cover by welding.

8. A tooth construction according to claim 4 wherein a breaking tip member is mounted at the juncture of the top and front walls of the top cover, the breaking tip member being secured thereto by welding.

9. A tooth construction according to claim 8 wherein a breaking tip member is mounted at the juncture of the top and front walls of the top cover, the breaking tip member being secured thereto by welding.

10. A tooth construction according to claim 2 wherein the front cover forms the front wall of an intermediate cover which also includes, opposed side walls, a top and an open rear wall overlying respective front, side and top faces of the support, the side and front walls each having at least one aperture formed therein to expose the underlying face of the support, the walls of the apertures being welded to the exposed underlying faces of the support.

11. A tooth construction according to claim 10 wherein a top cover is mounted on the intermediate cover, the top cover having a top wall portion and a front wall portion overlying the top wall and front wall of the intermediate cover, the top cover being secured to the intermediate cover by welding.

12. A tooth construction for a mineral breaker, the tooth construction including a tooth shaped support body having a solid core with no bores or apertures, covered by a shell which defines the outer shape of the tooth construction, the shell being composed of a plurality of covers which are fixedly secured to one another and/or to the support body by welding to define a unitary tooth construction the support body having a front face and an opposed rear face and the plurality of covers including at least a front cover which is weldingly secured to and fully seated in face to face contact with the front face of the support body and a separate rear cover which is weldingly secured to and fully seated in face to face contact with the rear face of the support body.

* * * * *